US006190221B1

(12) United States Patent
Nanami

(10) Patent No.: US 6,190,221 B1
(45) Date of Patent: Feb. 20, 2001

(54) CRANKCASE VENTILATING SYSTEM FOR PERSONAL WATERCRAFT

(75) Inventor: Masayoshi Nanami, Iwata (JP)

(73) Assignee: Yamaha Hatsudoki Kabushiki Kaisha, Hamamatsu (JP)

( * ) Notice: Under 35 U.S.C. 154(b), the term of this patent shall be extended for 0 days.

(21) Appl. No.: 09/261,265

(22) Filed: Mar. 3, 1999

(30) Foreign Application Priority Data

Mar. 3, 1998 (JP) ..... 10-050237

(51) Int. Cl.[7] ..... B63H 21/10

(52) U.S. Cl. ..... 440/88; 114/55.5; 123/572

(58) Field of Search ..... 440/900, 111, 440/88, 89, 38; 114/55.5; 123/572, 573

(56) References Cited

U.S. PATENT DOCUMENTS 5,460,552 * 10/1995 Blanchard et al. ..... 440/111
5,501,202 * 3/1996 Watanabe ..... 123/572

* cited by examiner

*Primary Examiner*—Ed Swinehart
(74) *Attorney, Agent, or Firm*—Knobbe, Martens, Olson & Bear LLP

(57) ABSTRACT

A four cycle power personal watercraft having an improved crankcase ventilating and induction system. The crankcase ventilating system ensures that the crankcase gases will be passed to the combustion chambers to eliminate unburned hydrocarbons from escaping to the atmosphere. However, the system is also designed so as to preclude separated lubricant from passing into the induction system and also to prevent water from entering the engine through the induction system or the ventilating system.

22 Claims, 6 Drawing Sheets

CRANKCASE VENTILATING SYSTEM FOR PERSONAL WATERCRAFT

BACKGROUND OF THE INVENTION

This invention relates to a personal watercraft powered by a four cycle internal combustion engine and more particularly to a crankcase ventilating systems for such watercraft.

In many applications employing internal combustion engines as power plants, two cycle engines have been widely used. The two cycle engine has a great advantage over four cycle engines in applications where small size, relatively simple construction and high specific power outputs are desired. Thus, in many types of marine applications such as in outboard motors or in small personal watercraft, two cycle engines have been popularly employed as the prime mover.

However, with increasing emphasis on environmental protection some of the disadvantages of two cycle engines are forcing consideration of utilization of four cycle engines in their place. However, because the four cycle engine is more complex and requires some components not normally associated with two cycle engines, this presents significant problems to the engineer.

In order to improve emission control for four cycle engines, there have been proposed crankcase ventilating systems where the blow by gases and other gases in the crankcase are discharged to the atmosphere through the combustion chamber of the engine rather than directly to the atmosphere. By passing these gases through the combustion chamber, a further time, hydrocarbons can be burned and the emission of these constituents to the atmosphere can be substantially reduced. However, these components generally require not only a crankcase recirculation system but also a vapor liquid separator so that the lubricant entrained with the ventilating gases can be condensed and return to the lubricating system for reuse.

Although these types of systems are well known in automotive and other applications, the utilization of these principals in connection with marine applications and particularly with personal watercraft presents unique problems.

Specifically, a personal watercraft is a type of watercraft that is quite sporting in nature and the hull of the watercraft may assume very extreme angles even when traveling normally on the body of water. Also, these watercrafts frequently may capsize and even though they are self righting, the crankcase ventilating system is exposed to conditions which never can exist in an automotive application.

It is, therefore, a principal object of this invention to provide an improved crankcase ventilating system for a personal watercraft four cycle engine.

It is a further object of this invention to provide a crankcase ventilating system for a personal watercraft that will be able to operate effectively and sustain conditions when the watercraft may reach extreme angles in its operation in the body of water.

As has been noted, it is desirable to ensure that any lubricating oil present in the crankcase ventilating gases can be separated and returned to the lubricating system for the engine rather than being discharged to the atmosphere or introduced into the induction system of the engine. This presents a significant problem when the watercraft may become inverted in use.

It is, therefore, a still further object of this invention to provide an improved crankcase ventilating system and oil separator for personal watercraft.

It is a further object of this invention to provide watercraft vapor separator for the crankcase ventilating system that will ensure against the passage of liquid lubricant to the induction system along with the ventilating gases regardless of how the watercraft may become oriented.

SUMMARY OF THE INVENTION

A first feature of this invention is adapted to be embodied in a personal watercraft having a hull defining an engine compartment in which a four cycle internal combustion engine is provided. The engine drives a propulsion device that is associated with the hull for propelling the personal watercraft through a body of water in which it operates. The engine has a crankcase ventilation system which includes a crankcase ventilating discharge that is disposed at a location in the engine that is disposed relatively high in the hull during normal watercraft operation. This crankcase ventilating system discharges the ventilating gases into the induction system for reintroduction into the combustion chamber through a crankcase ventilating return. This crankcase ventilating return is positioned at a relatively low position in the hull so that under normal watercraft operation and regardless of the orientation of the hull on the body of water in which it operates, the discharge end is always below the inlet end of the crankcase ventilating system.

Another feature of the invention is also adapted to be embodied in a personal watercraft having a hull defining an engine compartment in which a four cycle internal combustion engine is provided. This engine drives a propulsion device associated with the hull for propelling the hull through a body of water in which it is operating. A crankcase ventilating system is provided for collecting crankcase ventilating gases and delivering them to the induction system for further combustion of entrained hydrocarbons in the combustion chamber. An oil separator is provided in the crankcase ventilating system and defines a substantial internal volume. An inlet passage communicates with a lower portion of this volume and an outlet passage communicates with an upper portion of the volume so as to provide an area where lubricant may collect without passing to the outlet regardless of the orientation of the watercraft.

DETAILED DESCRIPTION OF THE PREFERRED EMBODIMENT OF THE INVENTION

Figure 1:
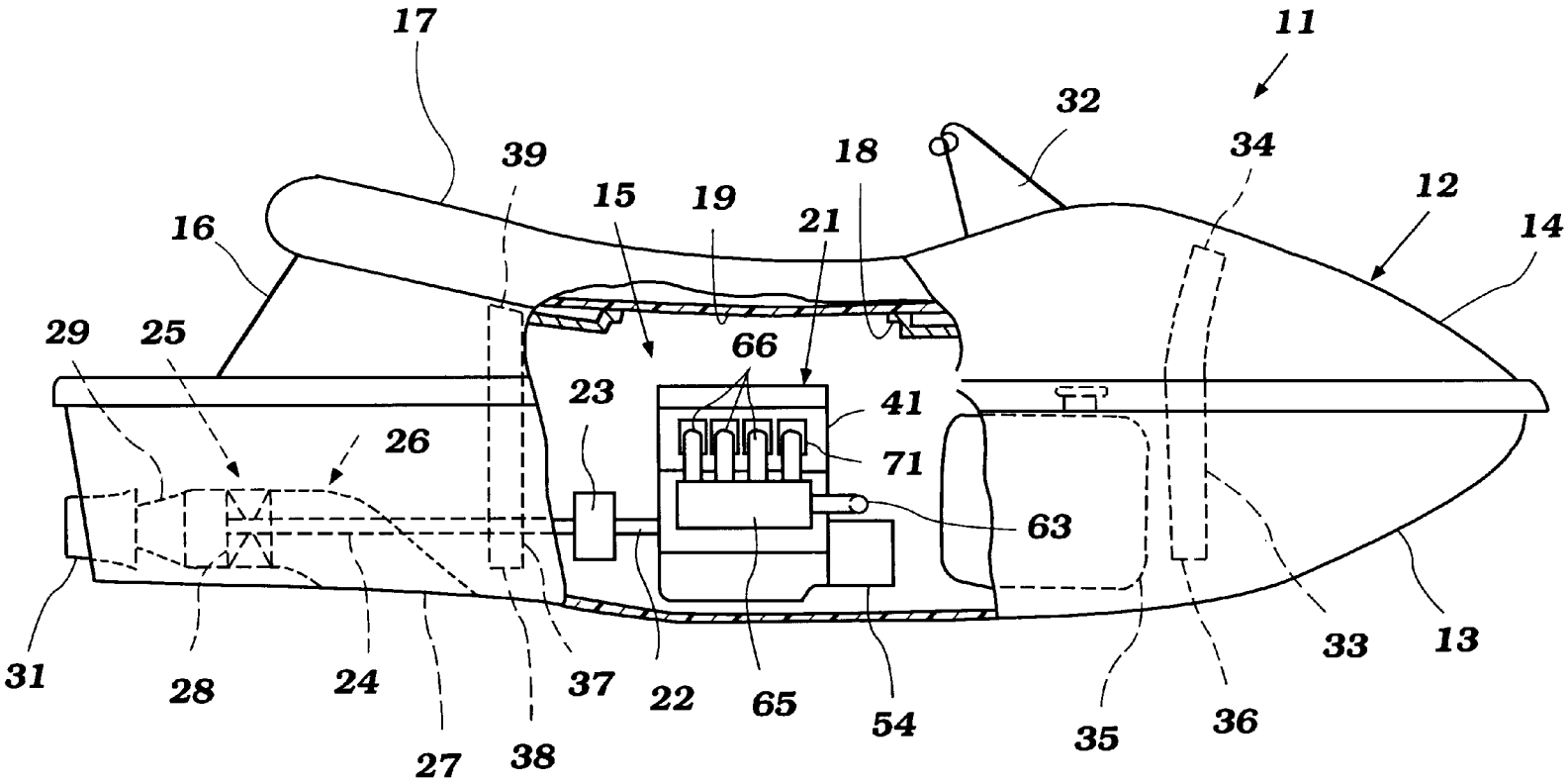
FIG. 1 is a side elevational view of a personal watercraft constructed in accordance with an embodiment of the invention, with a portion of the hull and seat broken away so as to more clearly show the orientation and construction of the engine within the engine compartment.
Figure 2:
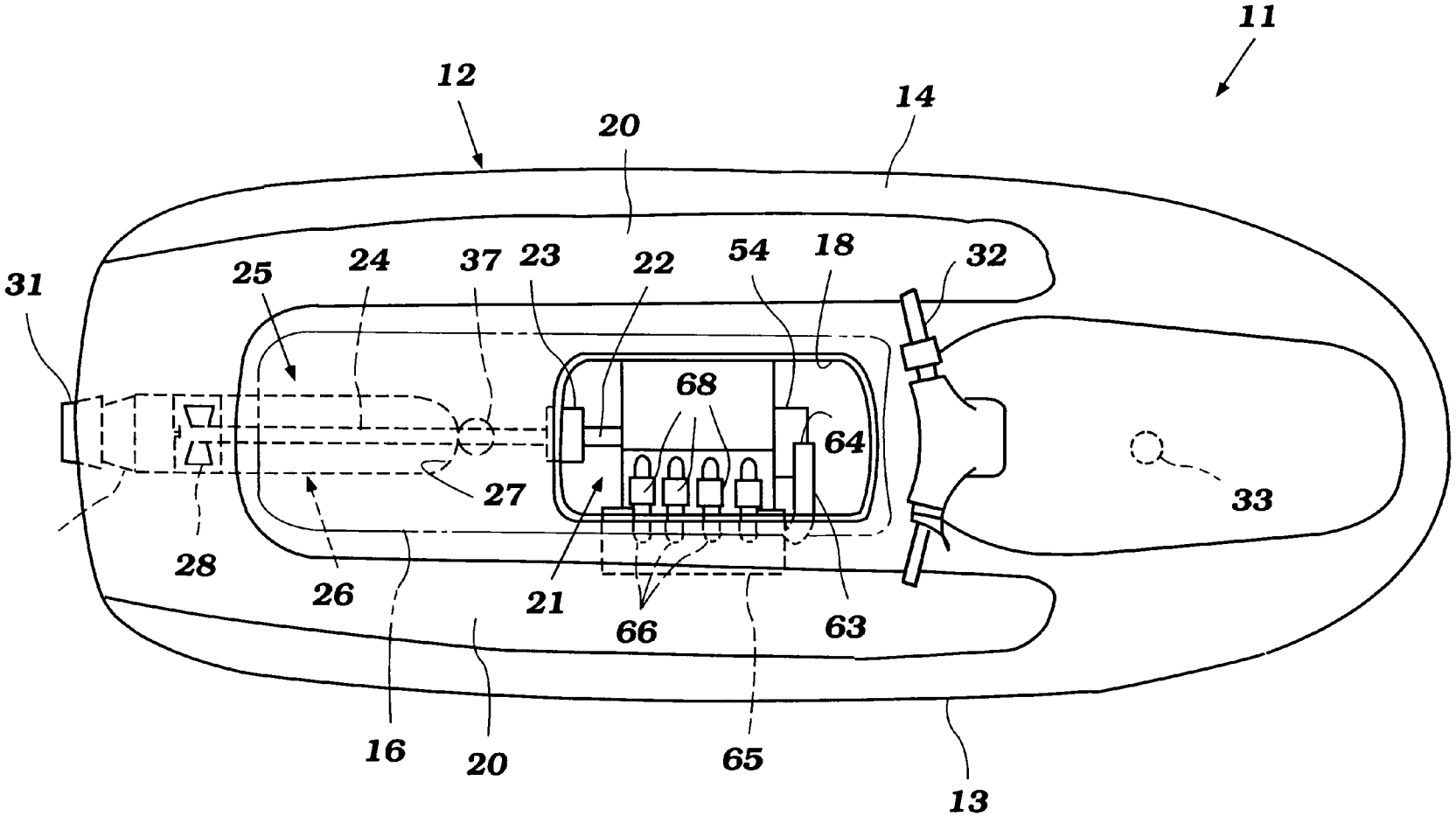
FIG. 2 is a top plan view of the watercraft shown in FIG. 1 with the seat removed to more clearly show the engine access area in the hull and the components of the engine visible therethrough.
Figure 3:
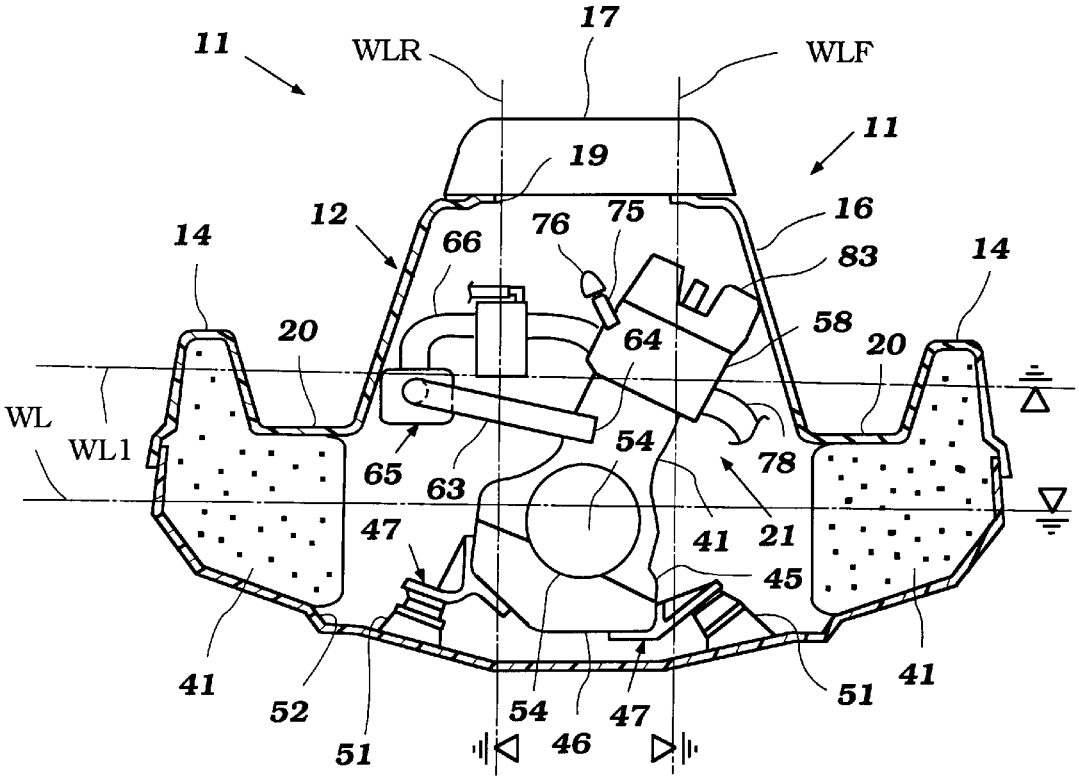
FIG. 3 is an enlarged transverse cross-sectional view of the watercraft looking from front to rear and at a position immediately forwardly of the engine.

Referring now in detail to the drawings and initially primarily to FIGS. 1–3, a personal watercraft constructed in accordance with an embodiment of the invention is identified generally by the reference numeral 11. The invention has particular utility in conjunction with a wide variety of types of personal watercraft. The specific configuration shown in the drawings is to be considered only typical of those with which the invention may be utilized. When the term "personal watercraft" is used herein and in the claims, it refers to the type of watercraft that is relatively small and sporting in nature and is designed primarily to be operated by a single rider passenger. No more than a few such as two or three additional passengers may be carried by the watercraft in the rider's area.

The watercraft 11 is comprised of a hull, indicated generally by the reference numeral 12 and which in the illustrated embodiment is comprised of a lower hull part 13 and an upper deck part 14. The hull and deck parts 13 and 14 are conveniently formed from a suitable material such as a molded fiberglass reinforced resin or the like. These hull parts are connected to each other in a suitable manner and define an internal portion which forms an engine compartment, indicated generally by the reference numeral 15.

The hull 12 defines a rider's area that is formed primarily by the deck portion 14 and specifically by a raise longitudinally extending pedestal 16 that extends over the engine compartment 15 and toward the rear of the hull 12. A seat 17 is removably positioned in whole or in part on this raised pedestal 16 so as to accommodate the rider/operator and his additional passengers, if any. These additional passengers are seated in straddle tandem fashion as is typical with many of these types of watercraft with their feet in foot areas 20 disposed on opposite sides of the raised portion 16.

The raised hull portion 16 has a generally horizontally extending part 18 that extends over the engine compartment 15 and which has an access opening 19 that is closed by the removable portion of the seat 17 so as to facilitate access to an internal combustion engine, indicated generally by the reference numeral 21 which is mounted in the engine compartment 15 in a manner to be described. The construction of the engine 21 will be described in more detail shortly by reference primarily to FIG. 4.

The engine 21 has a crankshaft 22 which rotates about a horizontally extending axis that is disposed on or close to the longitudinal centerline of the hull 12. The crankshaft 22 is connected by means of a transmission which includes a coupling 23 to the impeller shaft 24 of a jet propulsion unit, indicated generally by the reference numeral 25. The jet propulsion unit 25 is disposed beneath the rearward portion of the seat 17 and may be positioned at least in part in a tunnel formed on the underside of the hull lower portion 13.

The jet propulsion unit 25 has an outer housing 26 which either alone or through cooperation with the hull part 13 defines a downwardly facing water inlet opening 27. Water is drawn into this water inlet opening under the action of an impeller 28 that is affixed to the impeller shaft 24 and which pumps water through the jet propulsion unit housing 26.

This pumped water is discharged rearwardly trough a discharge nozzle 29 to provide a propulsive force for the watercraft 11. A steering nozzle 31 is positioned on the rear end of the discharge nozzle 29 and is steerable about a generally vertically extending steering axis for steering of the watercraft 11 in a manner well known in this art. A control mast 32 is provided forwardly of the seat 17 for the operator's control of the watercraft 11 including this steering action. In addition, the steering nozzle 31 may also be pivotal about a horizontal axis for watercraft trim adjustment.

The engine compartment 15 is ventilated by a vent pipe 33 that has an inlet opening 34 disposed at the forward end of the engine compartment 15 and forwardly of a fuel tank 35 that delivers fuel to the engine 21 for its operation. A discharge end 36 of the vent pipe 33 introduces ventilating gases to the forward area of the hull 12 so they can flow rearwardly to ventilate and cool the engine compartment 15.

A discharge pipe 37 is provided at the rearward portion of the engine compartment 15 and has a lower inlet end 38 that collects these ventilating gases. They are then discharged to the atmosphere through a discharge end 39 of the pipe 37 which extends upwardly and terminates beneath the seat 17 so as to be shielded from the atmospheric elements.

The hull 22 may be provided with buoyant masses, indicated generally at 41, on opposite sides of the gunnel portions and beneath the foot areas 20 so as to ensure that the watercraft will be relatively stable. Nevertheless, the watercraft can become capsized either to one side or the other as shown by the phantom lines in FIG. 3 which disclose either a left hand or right hand tilting of the hull. In addition, the hull actually may also become inverted so that the normal water level and inverted water levels also appear in this figure. These water levels are defined as WL, WLI, WLR and WLF for a reason which will become apparent.

The construction of the engine 21 will now be described by primary reference to FIG. 4, although its components also appear in FIGS. 1–3. In the illustrated embodiment, the engine 21 is depicted as being of the four cylinder, inline type and operates on a four cycle principal. Although the invention is described in conjunction with an engine having such cylinder numbers and orientation, it will be readily apparent to those skilled in the art how the invention can be practiced with a wide variety of engine types. The invention does have particularly utility, however, in conjunction with four cycle engines because these engines normally utilize closed lubricating systems and crankcase ventilation arrangements.

The engine 21 is comprised of a cylinder block 41 having four longitudinally spaced cylinder bores 42. These cylinder bores 42 have their axes lying in a common plane L which is inclined to one side of the vertical so as to afford better access for the components thereof for servicing.

Pistons 43 reciprocate in the cylinder bores 42 and are connected by means of connecting rods 44 to the throws of the crankshaft 22 for driving it in a manner well known in this art. The crankshaft 22 is rotatably journaled within a crankcase chamber formed by a skirt 45 of the cylinder block 41 and a crankcase member 46 that is detachably connected thereto.

A pair of engine mounts 47 are fixed to the crankcase member 46 and cooperate with elastomeric supports 48 which are interposed between mounting flanges 49 of the engine mounts 47 and pedestals 51 formed on the hull under portion 52 for support of the engine within the engine compartment 15.

Figure 4:
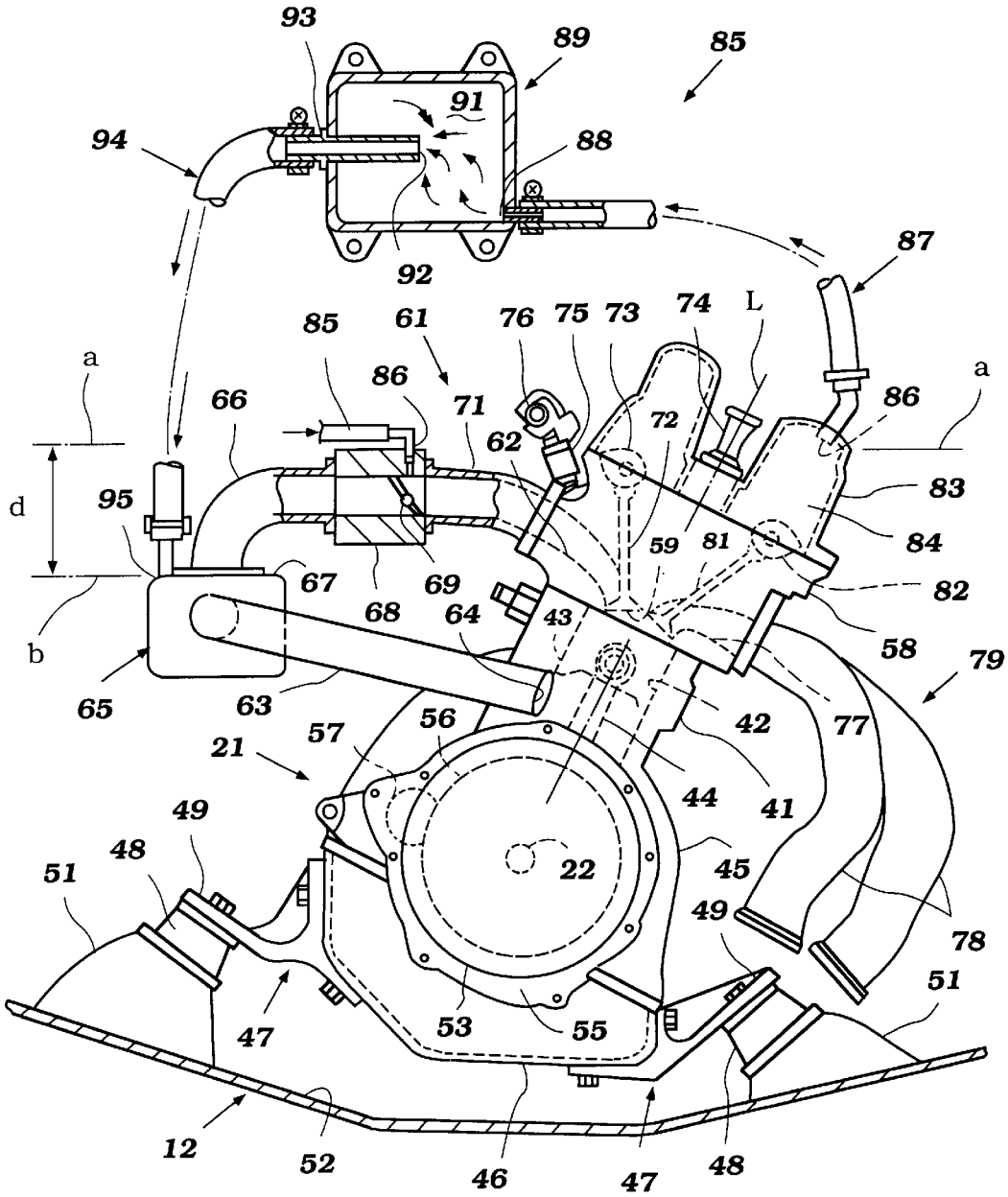
FIG. 4 is a further enlarged view looking in the same direction as FIG. 3 and shows portions of the engine ventilating system broken away and shown in sections.

At the forward end, a flywheel magneto 53 is affixed to the crankshaft 22 within a flywheel cover 54 which is removed in FIG. 4 but which is attached to a forwardly facing flange 55 of the cylinder block crankcase member assemblage 45, 46. A starter gear 56 is formed with this flywheel 53 and is engaged by a pinion gear 57 of a starter motor for electric starting of the engine 21.

A cylinder head assembly, indicated generally by the reference numeral 58, is affixed to the cylinder block 41 in a known manner and closes the upper end of the cylinder bores 42. This cylinder head assembly 58 has individual recesses 59 formed in its lower surface which cooperates with the heads of the pistons 43 and the cylinder bores 42 so as to form the combustion chambers of the engine.

An induction system, indicated generally by the reference numeral 61 is provided for delivering a charge to these combustion chambers through intake passages 62 formed on the upper or inlet side of the cylinder head assembly 58. This induction system includes an inlet pipe 63 that has an inlet end 64 disposed above the flywheel housing 54 in a sheltered area, as will be described shortly.

This inlet pipe 63 delivers the intake charge to an elongated plenum chamber device 65 that extends along one side of the engine 21. This plenum chamber 65 serves a plurality of branch passages 66 of an intake manifold assembly having a flange 67 that is fixed to the upper side of the plenum chamber 65. These manifold runner sections each have throttle bodies 68 formed therein in which throttle valves 69 are provided for controlling the flow of air charge to the engine through discharge passages 71 of the runner sections 66. These discharge passage portions 71 are fixed to the cylinder head 58 in registry with the cylinder head intake passages 62.

Intake valves 72 are supported within the cylinder head assembly 58 and are operated by a conventional twin overhead cam, valve actuating mechanism including an intake cam shaft 73 for opening and closing the intake passages 62. The intake cam shaft 73 is driven at one half crankshaft speed by any suitable drive arrangement.

Spark plugs 74 are mounted in the cylinder head assembly 58 with their spark gaps disposed centrally of the combustion chamber recesses 59 for firing a fuel charge which is mixed with the inducted air. The spark plugs are fired by a suitable ignition system.

The aforenoted fuel charge is supplied by a manifold fuel injection system including fuel injectors 75 that are mounted in the cylinder head assembly 58 and which spray into the intake passages 62. Fuel is supplied to the fuel injectors from the fuel tank 35 through a delivery system that includes a main fuel rail 76. Suitable high pressure and low pressure pumps and regulators may be employed so as to provide this fuel delivery.

The charge which is ignited by the spark plugs 74 will bum within the combustion chamber is then discharged through exhaust passages 77 formed in the cylinder head assembly 58 on the side opposite the intake passages 62. These exhaust passages 77 communicate with the runner section 78 of an exhaust manifold, shown partially and indicated generally by the reference numeral 79. This exhaust manifold communicates with a suitable exhaust system (not shown) for discharging the exhaust gases to the atmosphere.

The exhaust passages 77 are controlled by exhaust valves 81 which are operated by an exhaust cam shaft 82 through a suitable valve actuating mechanism of the type known in this art. This exhaust cam shaft 82, like the intake cam shaft 73 is driven by a suitable drive at one half crank shaft speed by any suitable timing drive.

The intake cam shaft 73 and the exhaust cam shaft 82 and the valve actuating mechanisms associated therewith are contained within a cam chamber 84 that is closed by a cam cover 83 that is affixed to and thus forms a portion of the cylinder head assembly 58 in a suitable manner.

The engine is provided with a suitable lubrication system which is not shown but which may include either a dry or wet sump system. This lubricating system also can supply lubricant through a conduit 85 and fitting 86 to the throttle body 68 for lubricating the throttle valve shafts associated with the throttle valves 69 so as to preclude corrosion thereof.

A system is provided for ventilating the crankcase chamber and collecting the blow by gases and returning them to the induction system. This crankcase ventilating system appears best in FIG. 4 and is identified generally by the reference numeral 85. To this end, a crankcase ventilating gas outlet 86 is formed in the cam cover 83 on the exhaust valve side of the cylinder head 58.

Crankcase gases are delivered to the valve chamber 84 through a suitable return system, as is known in this art. A crankcase ventilating pipe or flexible conduit 87 is connected at one end to the fitting 86 and at its other end to an inlet fitting 88 of an oil separator 89.

Basically the oil separator 89 is comprised of an outer housing that defines an internal cavity 91 and which is mounted at a suitable location relatively high in the engine compartment 15. Also, the inlet opening is much smaller in diameter than a ventilating outlet opening 92 formed by an outlet fitting 93 that is also fixed to the outer housing 89.

The outlet fitting 93 is disposed somewhat centrally in the chamber 91 and well above the lower end where the inlet 88 is positioned but below the upper surface of the outer housing for a reason which will be described shortly.

A return conduit 94 extends from the fitting 93 to a crankcase ventilating inlet fitting 95 that is fixed to the intake manifold plenum 65. Thus, the crankcase gases will be delivered to the induction system to be drawn into the combustion chambers 59. Thus, any hydrocarbons that may be present will be burned in the combustion chambers.

It should be noted that the inlet 86 for the crankcase ventilating system 85 is disposed at a height "a", which is substantially greater than the height "b" of the outlet 95 at a distance indicated at "d". Thus, even when the watercraft may be inclined as when turning sharply, the outlet of the crankcase ventilating system 95 will always be below the inlet 86.

Also, there is a possibility that the watercraft may be leaned over on one side or the other or inverted as shown in FIG. 3. It will be seen that the planes of the various levels of capsizing or inversion are such that the air inlet opening 64 is always provided position in a void area above the waterline in all possible orientations. Hence, water will not be inducted into the engine. Furthermore, if any water should enter this system, it is not likely to flow backward through the crankcase ventilating system 85 to the engine because the outlet 95 is well below the inlet 86.

Also, if the watercraft is inverted and water enters the engine compartment, on subsequent righting, the flywheel cover 64 will direct the water away from the inlet opening 64 and avoid its ingestion into the induction system.

Figure 5A:
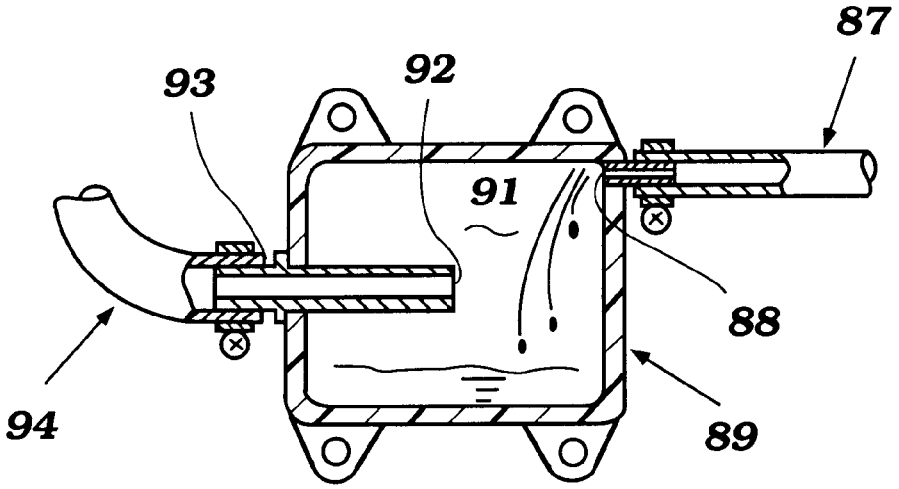
FIG. 5*a* is a view looking in the same direction as FIG. 4 but shows the condition when the watercraft is inverted.
Figure 5B:
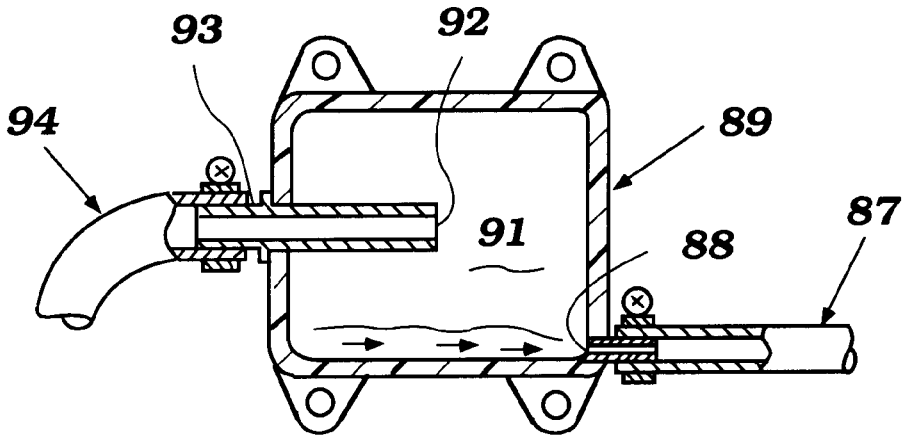
FIG. 5*b* is a view showing the same components but with the watercraft again righted.

FIGS. 5*a* and 5*b* show a condition when the watercraft is first inverted and subsequently righted. It will be seen that the volume of the chamber 91 is fairly large, for example something in the order of 60 cubic centimeters (cc) so that the amount of lubricant which is condensed will collect even in the inverted stage and will never reach the outlet fitting 93 as seen in FIG. 5*a*. Hence, when the watercraft is again righted this lubricant will flow back into the engine through the line 87 and into the cam cover 83. This lubricant can then drain back into the crankcase.

Figure 6:
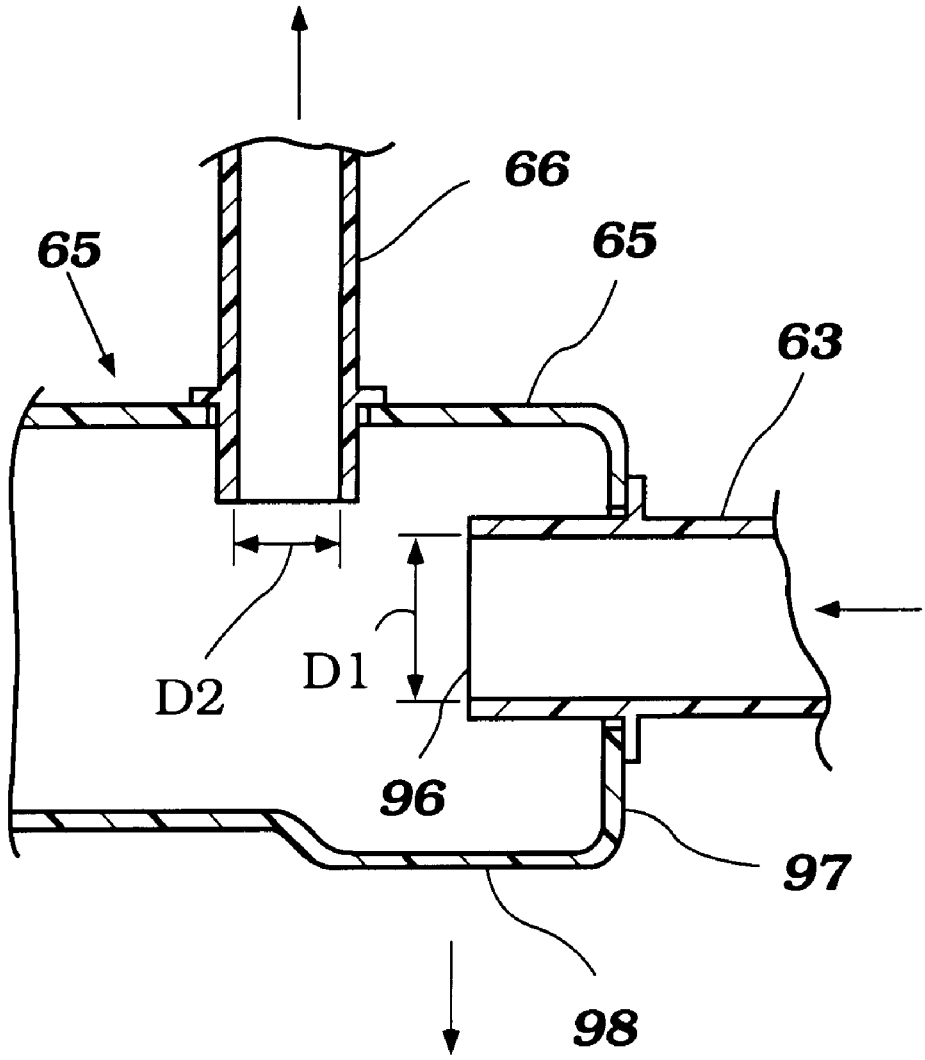
FIG. 6 is an enlarged cross-sectional view taken through the air inlet device for the engine induction system.

FIG. 6 also shows how the induction system is configured so that it will ensure against water entering the engine through this path. It will be seen that the inlet pipe 63 has a diameter D1 at its open end 96 into the interior of the plenum chamber housing. There is a small well formed by a portion 97 adjacent the end that has a weep hole 98 through which water can drain. The induction system inlet pipe 66 has a diameter D2 that is such so that the effective diameter D1 is more than or equal to twice the diameter D2. That is:

$$D1 \geqq 2D2$$

This will further promote water condensation in the plenum chamber 65 for draining out of the weep hole 98.

Thus, from the foregoing description it should be readily apparent that the described system provides very effective crankcase ventilation for a four cycle engine for a personal watercraft that will ensure that water cannot enter the lubricating system through the crankcase ventilating system and also so that lubricant will be returned to the crankcase rather than flow as a liquid to the induction system. However, hydrocarbons that are still in vapor form will readily pass through to the combustion chamber for further combustion therein to reduce the amount of unburned hydrocarbons emitted to the atmosphere.

Of course, the foregoing description is that of a preferred embodiment of the invention and various changes and modifications may be made without departing from the spirit and scope of the invention, as defined by the appended claims.

What is claimed is:

1. A personal watercraft having a hull defining an engine compartment, a four cycle internal combustion engine in said engine compartment, said engine driving a propulsion device associated with said hull for propelling said personal watercraft through a body of water in which it operates, said engine having a crankcase ventilation system including a crankcase ventilating discharge that is disposed at a location in said engine that is disposed relatively high in said hull during normal watercraft operation, and a crankcase ventilating return for said crankcase ventilating system for discharging the ventilating gases into an induction system of said engine for introduction into a combustion chamber thereof, said crankcase ventilating return being positioned at a relatively low position in said hull so that under normal watercraft operation and regardless of the orientation of said hull on the body of water in which it operates said ventilating return is always below said ventilating discharge of said crankcase ventilating system.

2. A personal watercraft as set forth in claim 1 wherein the internal combustion engine has at least one overhead cam shaft journalled in a cam chamber of a cylinder head of said engine.

3. A personal watercraft as set forth in claim 2 wherein the ventilating discharge is in the cam chamber.

4. A personal watercraft as set forth in claim 1 wherein the engine has multiple cylinders and the induction system includes a plenum chamber.

5. A personal watercraft as set forth in claim 4 wherein the ventilating return is in the plenum chamber.

6. A personal watercraft as set forth in claim 5 wherein the internal combustion engine has at least one overhead cam shaft journalled in a cam chamber of a cylinder head of said engine and the ventilating discharge is in the cam chamber.

7. A personal watercraft as set forth in claim 1 further including an oil separator positioned in the crankcase ventilating system for separating lubricant from the crankcase ventilating gasses and returning said separated lubricant to the engine lubricating system.

8. A personal watercraft as set forth in claim 7 wherein the oil separator is disposed vertically above the ventilating discharge for returning of the separated lubricant to the cam chamber by gravity.

9. A personal watercraft as set forth in claim 8 wherein the oil separator is located at the highest vertical area of the crankcase ventilating system.

10. A personal watercraft as set forth in claim 7 wherein the oil separator is formed as an outer housing defining an internal volume, an inlet passage communicating with a lower portion of said internal volume and an outlet passage communicating with an upper portion of said internal volume.

11. A personal watercraft as set forth in claim 10 wherein the oil separator internal volume provides an area where lubricant may collect without passing to the outlet regardless of the orientation of said personal watercraft.

12. A personal watercraft as set forth in claim 11 wherein the outlet passage communicating with an upper portion of the internal volume below its upper surface so as to define volumes above and below said outlet passage to retain separated lubricant in either an upright or an inverted condition and prevent said separated lubricant from entering said outlet passage.

13. A personal watercraft as set forth in claim 1 wherein the hull defines a rider's area that lies at least in part above the engine compartment and defines an access opening overlying the engine.

14. A personal watercraft as set forth in claim 13 wherein the access opening is closed at least in part by a removable seat part.

15. A personal watercraft as set forth in claim 14 wherein the internal combustion engine has at least one overhead cam shaft journalled in a cam chamber of a cylinder head of said engine and the ventilating discharge is in the cam chamber.

16. A personal watercraft as set forth in claim 14 wherein the engine has multiple cylinders and the induction system includes a plenum chamber.

17. A personal watercraft as set forth in claim 16 wherein the ventilating return is in the plenum chamber.

18. A personal watercraft as set forth in claim 17 wherein the internal combustion engine has at least one overhead cam shaft journalled in a cam chamber of a cylinder head of said engine and the ventilating discharge is in the cam chamber.

19. A personal watercraft having a hull defining an engine compartment in which a four cycle, internal combustion engine is provided, said engine driving a propulsion device associated with said hull for propelling said hull through a body of water in which it is operating, a crankcase ventilating system for collecting crankcase ventilating gases from said engine and delivering them to an induction system of said engine for combustion of entrained hydrocarbons in a combustion chamber of said engine, and an oil separator in said crankcase ventilating system, said oil separator having an outer housing defining an internal volume, an inlet passage communicating with a lower portion of said internal volume and an outlet passage communicating with an upper portion of said internal volume at a point below the upper end of said internal volume so as to provide an area where lubricant may collect without passing to said outlet passage even if the orientation of said personal watercraft becomes inverted.

20. A personal watercraft as set forth in claim 19 wherein the outlet passage communicates with the internal volume above its lower surface so as to define volumes below as well as above said outlet passage to retain separated lubricant in either an upright or an inverted condition and prevent said separated lubricant from entering said outlet passage.

21. A personal watercraft as set forth in claim 20 wherein the hull defines a rider's area that lies at least in part above the engine compartment and defines an access opening overlying the engine.

22. A personal watercraft as set forth in claim 21 wherein the access opening is closed at least in part by a removable seat part.

* * * * *